US005767681A

United States Patent [19]

Huang

[11] Patent Number: 5,767,681

[45] Date of Patent: Jun. 16, 1998

[54] TIMING LIGHT FOR AUTOMOTIVE ENGINES

[75] Inventor: David Y. Huang, Costa Mesa, Calif.

[73] Assignee: Innova Electronics Corporation, Fountain Valley, Calif.

[21] Appl. No.: 709,586

[22] Filed: Sep. 9, 1996

[51] Int. Cl.[6] ..... F02P 17/06; F02P 5/15

[52] U.S. Cl. ..... 324/392; 324/391; 73/116

[58] Field of Search ..... 324/378, 391, 324/392; 73/116, 117.3

[56] References Cited

U.S. PATENT DOCUMENTS

| | | | |
|---|---|---|---|
| D. 345,117 | 3/1994 | Pacetti et al. | D10/112 |
| 2,644,131 | 6/1953 | Walraven et al. | 324/391 |
| 2,664,012 | 12/1953 | Newsome | 73/116 |
| 2,703,376 | 3/1955 | Board | 315/219 |
| 2,787,760 | 4/1957 | Sammis et al. | 324/379 |
| 2,959,711 | 11/1960 | Parmater et al. | 315/224 |
| 3,004,191 | 10/1961 | Umbarger | 315/219 |
| 3,042,835 | 7/1962 | Badger | 315/171 |
| 3,286,165 | 11/1966 | Small | 324/391 |
| 3,364,418 | 1/1968 | MacCrea | 324/392 |
| 3,368,143 | 2/1968 | Roberts et al. | 324/392 |
| 3,573,609 | 4/1971 | Vaher | 324/391 |
| 3,665,294 | 5/1972 | Pelta et al. | 324/392 |
| 3,743,922 | 7/1973 | Festos | 324/399 |
| 3,775,672 | 11/1973 | Letosky | 324/392 |
| 3,781,656 | 12/1973 | Glew | 324/392 |
| 3,793,584 | 2/1974 | Liebermann et al. | 324/399 |
| 3,813,931 | 6/1974 | Rennick et al. | 73/116 |
| 3,872,376 | 3/1975 | Kalenevitch | 324/392 |
| 3,955,135 | 5/1976 | Fastaia | 324/384 |
| 3,986,009 | 10/1976 | Fastaia | 235/151 |
| 4,008,430 | 2/1977 | Blum | 324/402 |
| 4,010,414 | 3/1977 | Reeves et al. | 324/392 |
| 4,063,152 | 12/1977 | Reeves | 324/392 |
| 4,070,613 | 1/1978 | Brady | 324/392 |
| 4,081,995 | 4/1978 | Griffith et al. | 73/116 |
| 4,092,585 | 5/1978 | Bovenlander | 324/392 |
| 4,095,170 | 6/1978 | Schmitt | 324/392 |
| 4,095,179 | 6/1978 | Bremer et al. | 324/207.22 |
| 4,106,461 | 8/1978 | Giannini | 123/148 |
| 4,117,395 | 9/1978 | Redfield | 324/391 |
| 4,125,894 | 11/1978 | Cashel et al. | 364/442 |
| 4,128,005 | 12/1978 | Arnston et al. | 73/117 |
| 4,158,305 | 6/1979 | Shipley | 73/119 |
| 4,337,515 | 6/1982 | Kreft | 364/551 |
| 4,395,680 | 7/1983 | Slutzky | 324/392 |
| 4,413,508 | 11/1983 | Kawamura et al. | 73/116 |
| 4,417,211 | 11/1983 | Ciriacks et al. | 324/392 |
| 4,441,360 | 4/1984 | Dooley et al. | 73/119 |
| 4,449,100 | 5/1984 | Johnson et al. | 324/378 |
| 4,454,475 | 6/1984 | Tsuchiya | 324/392 |
| 4,469,952 | 9/1984 | Olson et al. | 250/551 |
| 4,472,779 | 9/1984 | Marino et al. | 364/431 |
| 4,517,833 | 5/1985 | Wesley | 73/119 |
| 4,594,886 | 6/1986 | Chen | 73/116 |
| 4,713,617 | 12/1987 | Michalski | 324/395 |
| 4,965,494 | 10/1990 | Wisneski, Jr. et al. | 315/241 |
| 5,023,764 | 6/1991 | McKinnon et al. | 362/299 |
| 5,146,168 | 9/1992 | Shaland | 324/392 |
| 5,387,870 | 2/1995 | Knapp et al. | 324/379 |

*Primary Examiner*—Glenn W. Brown

*Attorney, Agent, or Firm*—Stetina Brunda Garred & Brucker

[57] ABSTRACT

A timing light for adjusting an engine's timing has a stroboscopic lamp for illuminating the timing marks and a trigger circuit for causing the stroboscopic lamp to illuminate the timing marks at a desired time. The trigger circuit has an input circuit receiving a signal representative of a spark plug firing; an output circuit providing a trigger signal to the stroboscopic lamp to cause the stroboscopic lamp to flash; and an anticipation circuit configured to determine when to provide the trigger signal to the stroboscopic lamp by establishing a trend in the rate of which the spark plug is firing so as to predict when a next trigger signal is to be provided by the output circuit. Establishment of the trend in the rate of which the spark plug is firing generally enhances the accuracy with which the engine's timing is measured.

9 Claims, 5 Drawing Sheets

TIMING LIGHT FOR AUTOMOTIVE ENGINES

FIELD OF THE INVENTION

The present invention relates generally to automotive maintenance equipment and more particularly to an automotive timing light which establishes a trend in the rate at which the speed of an engine is changing so as to enhance the accuracy with which an engine's timing is measured.

BACKGROUND OF THE INVENTION

Timing lights for use in engine tune-ups are well known. Such timing lights allow a user to determine when a spark plug is firing relative to the position of a piston within a cylinder.

In a gasoline engine it is common to fire the spark plugs before the pistons reach the top dead center (TDC) position. Similarly, it is common to fire the spark plugs of a diesel engine after the pistons pass top dead center. Such advancing or retarding of the timing, i.e., firing of the spark plugs, tends to optimize the performance of the engine according to well known principles.

A timing light triggers on the electrical pulse provided to the spark plug (typically for the number one cylinder), such that the timing marks on a rotating portion of the crank shaft, typically the water pump pulley, and the stationary engine indicate the position of the piston within the cylinder. The position of the piston is indicated in degrees, thus providing the number of degrees by which the crankshaft must be rotated to bring the piston to the top dead center.

Early timing lights fired substantially at the instant that the electrical spark pulse was sensed. Thus, the timing marks were illuminated before the piston reached top dead center for gasoline engines and thereafter for diesel engines. Typically, an index mark is provided on the rotating pulley connected to the crankshaft and a scale is formed on the stationary engine, typically upon a small plate attached thereto. This arrangement necessitates careful reading of the alignment of the index on the pulley with respect to the stationary scale. Frequently, it is difficult to distinguish among the different marks formed upon scale. The mark is usually easiest to recognize, since it is typically the longest.

An improvement to such early timing lights comprised adding either a meter or a calibrated knob to the timing light itself, from which the angular position of the piston could be read directly. With such an improved timing light it is merely necessary to adjust the engine, timing until the timing index mark on the rotating pulley aligns with the comparatively easy to read zero index on the stationary engine. It is not necessary to read the smaller numbers on scale on the stationary engine. When the two index marks are aligned, then the engine timing is that indicated on the meter or the calibrated knob of the timing light.

It is also known to provide index marks on both the rotating pulley and the stationary engine which are configured such that they are aligned when the spark plug fires if the engine timing is correct. This eliminates the need for any reading of engine timing on either a scale formed on the stationary engine or from a meter or calibrated knob on the timing light.

For contemporary timing lights using a scale or calibrated meter, it is necessary to delay illumination of the timing marks by the stroboscopic lamp of the timing light by a sufficient amount of time to allow the piston to reach top dead center to account for the timing advance of gasoline engines as the timing retardation of diesel engines.

When triggering of the stroboscopic lamp is to be delayed, as in meter or calibrated knob timing lights, then since the stroboscopic lamp is not triggered directly from the spark plug pulse, the time for triggering the delayed flash must be computed. According to one prior art device, disclosed in U.S. Pat. No. 4,095,170 issued to Schmitt on Jun. 13, 1978, the time for triggering the stroboscopic lamp is calculated by simply making the time interval between the last flash and the next flash equal to the time interval between the last flash and the flash prior to that. That is, the Schmitt device merely assumes that the engine is running at a constant speed.

Although such contemporary timing lights as the Schmitt device have proven generally suitable for their intended use, they suffer from the inherent deficiency that inaccurate engine timing indications are provided when the engine speed is changing. For example, when the engine speed is increasing, the time interval between successive spark plug firings is decreasing. Thus, a method for calculating the time for firing the stroboscopic lamp according to Schmitt will cause the stroboscopic lamp to illuminate at a later point in time, i.e., after the timing marks have already aligned, thus providing a false indication of a shift in engine timing.

As such, it would be desirable to accurately predict the time at which to trigger the stroboscopic lamp of an engine timing light so as to provide an accurate indication of engine timing when the speed of the engine is changing.

Even in engine timing lights which do not utilize a delay, i.e., which trigger directly from the spark plug pulse, it would be beneficial to provide a means for predicting when to trigger the stroboscopic lamp so as to provide for a more accurate engine timing indication thereby. Even with such a direct acting timing light, internal delays caused by the inherent reaction times of the electronic components thereof reduce the accuracy of timing measurement, particularly at higher engine speeds. Thus, even in such direct acting timing lights, it would be beneficial to predict the time at which to illuminate the stroboscopic lamp thereof, particularly at higher and/or changing engine speeds.

SUMMARY OF THE INVENTION

The present invention specifically addresses and alleviates all of the above-mentioned deficiencies associated with the prior art. More particularly, the present invention comprises a timing light for making timing marks on an engine appear stationary, so as to facilitate adjustment of the engine's timing, wherein the timing light comprises a stroboscopic lamp for illuminating the timing marks and a trigger circuit for causing the stroboscopic lamp to illuminate the timing marks at a desired time.

The timing circuit comprises an input circuit which receives a signal representative of a spark plug firing. As in the prior art, this is typically accomplished by attaching an inductive probe to the spark plug wire for the number one cylinder of the automobile engine.

The trigger circuit further comprises an output circuit for providing a trigger signal to the stroboscopic lamp to cause the stroboscopic lamp to flash at a desired time.

According to the present invention, the trigger circuit further comprises an anticipation circuit configured to determine when to provide the trigger signal of the stroboscopic lamp by establishing a trend in the rate at which the spark plug is firing so as to predict when a next trigger signal is to be provided by the output circuit.

More particularly, the anticipation circuit is configured to determine when to generate a next trigger signal by extrapolating the time of the next trigger signal by determining a rate of change of times between a plurality of prior trigger signals. The step of extrapolating the time of the next trigger signal preferably comprises determining the period between a plurality of prior trigger signals and offsetting the time of the next trigger signal by a factor corresponding to the rate of change of prior trigger signals.

By establishing a trend in the rate at which the spark plug is firing, the accuracy with which the engine's timing is measured is enhanced.

The anticipation circuit is preferably configured to establish a trend utilizing at least a first derivative of the engine speed with respect to time. A second derivative of the engine speed with respect to time and/or further derivatives may additionally be utilized to better establish the trend and further enhance the accuracy with which engine timing is indicated.

According to the preferred embodiment of the present invention, a data set of engine speed versus time is formed. The first and any further desired derivatives, or slope of engine speed versus time at the time of sensing of the last spark plug pulse is calculated according to well known methodology. The time at which the next spark plug pulse is anticipated is then calculated from the first and any further derivative and the time delay then calculated from this predicted interval.

Optionally, the anticipation circuit operates in two different modes. The anticipation circuit operates in a first mode when the engine speed is substantially steady. In the first mode, the time at which the trigger signal is provided to the stroboscopic lamp is determined utilizing a weighted average of a plurality of previous time intervals between trigger signals. Preferably, the weighted average is determined by adding one half of the previous time interval to one fourth of the time interval before that to one fourth of the time interval before that. In this manner, the most recent interval contributes twice as much to the calculation of the next interval as do the two intervals before that.

The anticipation circuit operates in a second mode when the engine speed is changing substantially. In the second mode, the time at which the trigger signal is provided to the stroboscopic lamp is determined utilizing at least a first derivative of the engine speed with respect to time, as discussed above.

The desired time for the stroboscopic lamp to illuminate the timing marks is a time delayed by an amount of time by which the engine timing is to be advanced when advanced engine timing is desired and is a time which is delayed by an amount of time by which the engine timing is to be retarded when retarded engine timing is desired.

The anticipation circuit may be configured to operate in the first mode when a predetermined number of previous time intervals have been within a predetermined range (indicating a substantially steady engine speed) and the anticipation circuit is further configured to operate in the second mode when a predetermined number of previous time intervals have been outside of the predetermined range (indicating a substantially changing engine speed).

Alternatively, the anticipation circuit may be configured to operate in the second mode when a predetermined number of previous time intervals have been either progressively shorter in duration (indicating an increase in engine speed) or progressively longer in duration (indicating a decrease in engine speed), and otherwise to operate in the first mode thereof.

Thus, according to the present invention, a timing light which anticipates the correct time to trigger the stroboscopic lamp based upon a trend in a changing engine speed is provided so as to give the user a more accurate indication of engine timing.

DETAILED DESCRIPTION OF THE PREFERRED EMBODIMENTS

The detailed description set forth below in connection with the appended drawings is intended as description of the presently preferred embodiment of the invention and is not intended to represent the only form in which the present invention may be constructed or utilized. The description sets forth the functions and the sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The timing light of the present invention is illustrated in FIGS. 1–5 which depict a presently preferred embodiment thereof.

Figure 1:
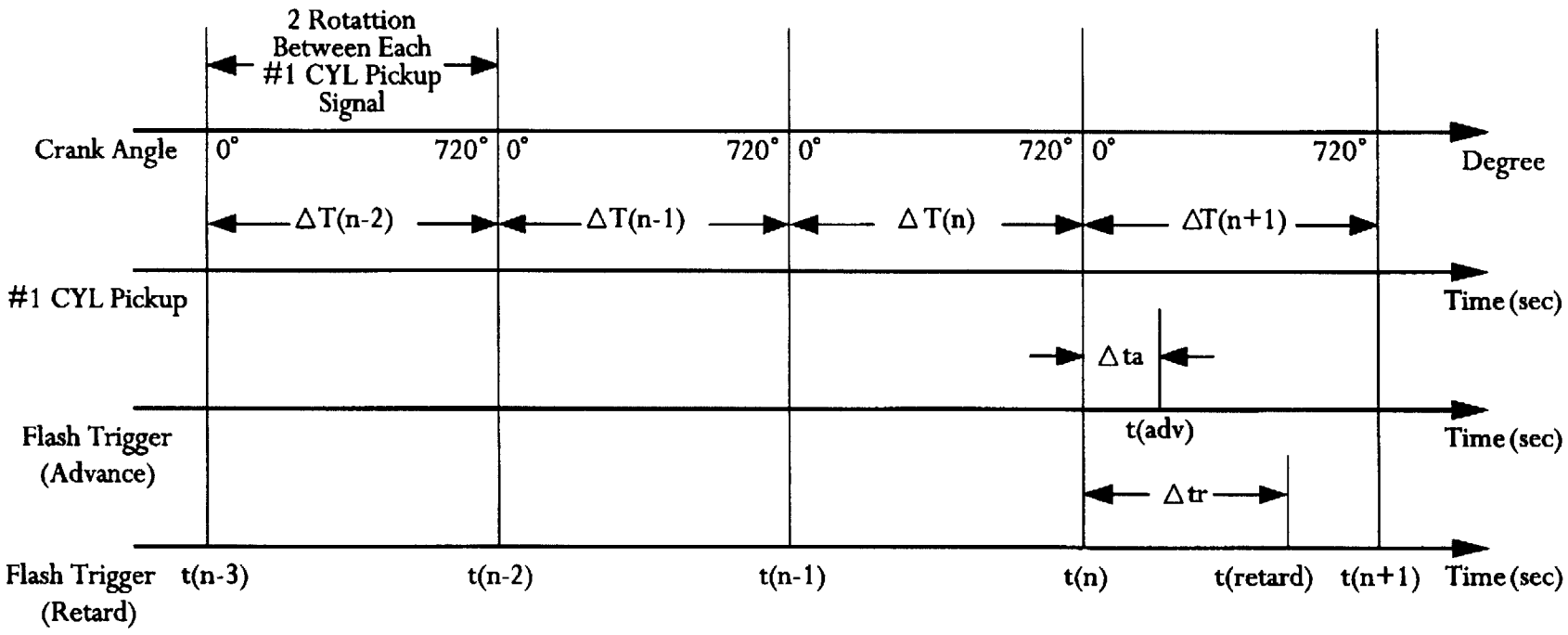
FIG. 1 is a timing diagram showing the relative timing for an advanced flash trigger and a retarded flash trigger with respect to the crank angle and the number one cylinder piston position.

Referring now to FIG. 1, a timing diagram illustrates the relative timing between the advance flash trigger, retarded flash trigger, crank shaft angle, and angular position of the piston in the number one cylinder. As shown in FIG. 1 t(n) is the time at which an electrical pulse to the spark plug of the number one cylinder is sent. t(n−1), t(n−2) and t(n−3) indicate the times at which the three preceding electrical pulses to the spark plug of the number one cylinder were received. t(n+1) indicates the time at which the next electrical pulse to the spark plug of the number one cylinder is to be sensed. Of course, when the engine speed is changing, the precise time at which t(n+1) is to occur is unknown. $\Delta T(n)$ is the time interval between the last two sensed electrical pulses to the spark plug of the number one cylinder. $\Delta T(n-1)$ and $\Delta T(n-2)$ are the prior two intervals between successive sensed electrical pulses to the spark plug of the number one cylinder. $\Delta T(n+1)$ is the time interval between the last sensed electrical pulse to the spark plug of the number one cylinder and the next sensed electrical pulse which will occur at t(n+1), and thus is of unknown duration.

$\Delta ta$ is the interval between the last sensed electrical pulse to the spark plug of the number one cylinder at t(n) and t(adv), which is the time at which the stroboscopic lamp is to be triggered when advanced timing is desired.

Similarly, $\Delta tr$ is the time interval between the time that the last electrical pulse to the spark plug of the number one cylinder t(n) and the time t(retard) that the stroboscopic lamp is to be triggered when retarded timing is desired.

It is important to note that the crank shaft performs two complete rotations, i.e., 720°, between each sensed electrical pulse to the spark plug of the number one cylinder, since in a contemporary four stroke cycle engine the piston raises to top dead center twice for each cycle (once on a compression stroke and once on an exhaust stroke).

The flash trigger timing for t(n) for advanced timing, i.e., Δta and for retarded timing Δtr is calculated as follows:

D=Degree of Advanced or Retarded Timing $\Delta T(n+1)=t(n-1)-t(n)$, $\Delta T(n)=t(n)-t(n-1)$ Rotation Per Minute at Time t(n):

$rpm|@t(n)|=2*60/|t(n)-t(n-1)|=120/\Delta T(n)$

For Advanced Timing:

$\Delta ta=D*|t(n+1)-t(n)|/(2*360)\ D*\Delta T(n+1)/720$

For Retarded Timing:

$\Delta tr=\Delta T(n+1)-D*|t(n+1)-t(n)|/(2*360)\ \Delta T(n+1)-D*\Delta T(n+1)/720$ According to the preferred embodiment of the present invention, the timing gun operates in one of two different modes depending upon whether the engine is running at a substantially steady speed or the speed thereof is changing substantially.

In a first mode, wherein the engine is running at a substantially steady speed, the time at which the trigger signal is provided to the stroboscopic lamp is determined utilizing a weighted average of a plurality of previous time intervals between trigger signals according to a first algorithm.

Figure 2:
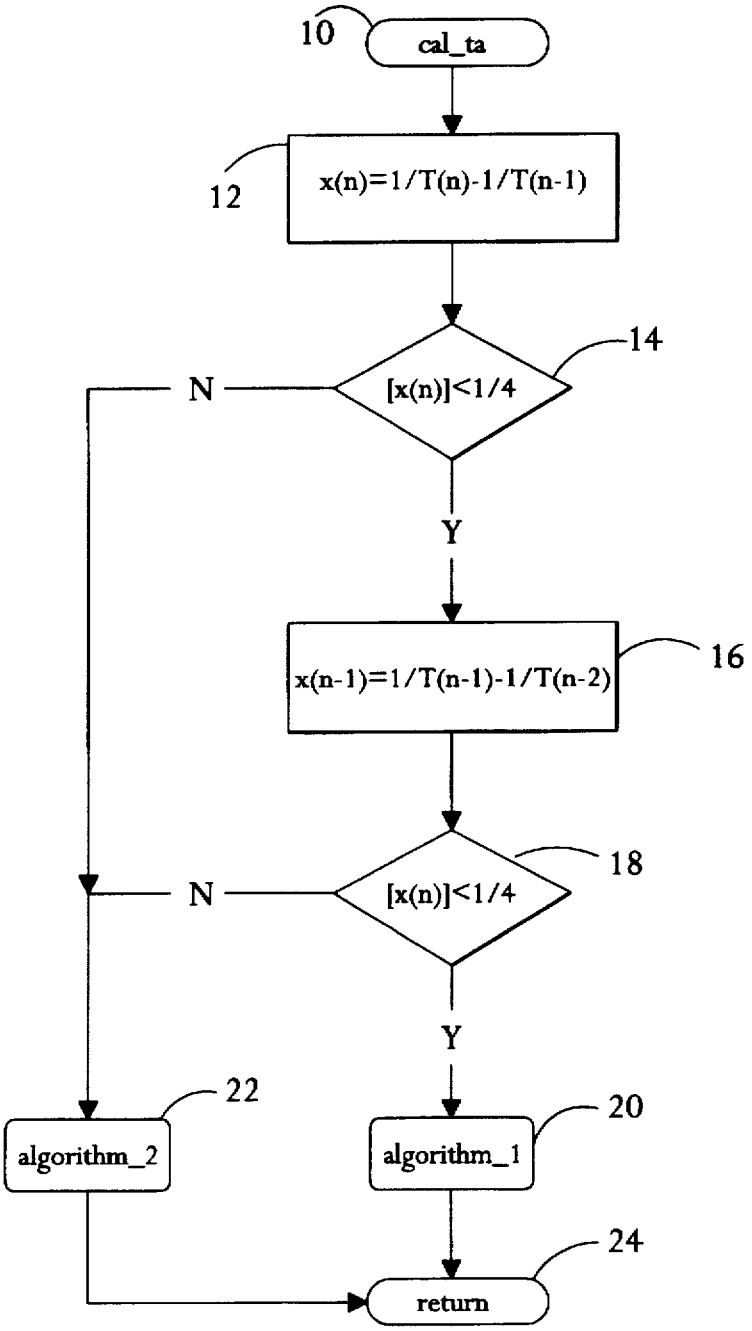
FIG. 2 is a flow diagram showing the decision making process for determining whether to perform algorithm one or algorithm two.

Referring now to FIG. 2, a flow diagram illustrating the decision process for selecting either algorithm 1 or algorithm 2 is shown.

The time delay necessary to cause the stroboscopic lamp to flash when the timing marks are aligned, i.e., when the piston in the number one cylinder is at top dead center, is calculated at 10. As those skilled in the art will appreciate, it is necessary to introduce such a time delay when utilizing digital timing lights, such as those utilizing either a meter or calibrated knob to indicate engine timing. The desired engine timing is entered into the timing light via either a knob or key pad and the distributor is then rotated so as to cause the index on the pulley to align with the 0° indication on the rotating pulley and stationary engine. Since the spark plug for the number one cylinder is actually firing several degrees before top dead center, the lack of such a time delay would cause the stroboscopic lamp to flash when the index mark on the rotating pulley is aligned with the appropriate degree mark on the stationary engine. However, since it is generally easier to read a 0° indication, the delay is introduced and the stroboscopic lamp is flashed at a later point in time, when the piston is at top dead center and the index mark on the rotating pulley aligns with the 0° indication on the stationary engine. Since the delay is determined by the desired engine timing entered into the timing light by the user, correct engine timing is indicated when the index mark on the rotating pulley aligns with the 0° indication on the stationary engine.

The difference between the most recent time interval and the time interval previous to that is next calculated so as to determine which of the two algorithm to be utilized to predict the time at which the stroboscopic lamp is next to be illuminated. Utilizing the formula $x(n)=1/T(n)-1/T(n-1)$ calculates x(n) which is the difference in the number of cycles or pulses per second between the last interval and the interval prior to that.

A decision 14 is then made such that if the difference between the number of cycles per second for the last interval and the interval prior to that is less than one fourth of a cycle, then algorithm one 20 may be run, otherwise algorithm two 22 is run. However, before algorithm one 20 is actually run, another test 16 is performed to determine whether the number of cycles per second for the prior interval is more than one fourth of a cycle different from the number of cycles per second for the interval prior to that. Again, if the difference between these two intervals is more than one fourth of a cycle, then algorithm two 22 is utilized, otherwise algorithm one 20 is utilized.

As discussed above, algorithm one 20 is utilized when the engine is running at a substantially steady speed and utilizes a weighted average of a previous plurality of cycles to calculate the time at which the stroboscopic lamp is to flash. Algorithm two 22 is utilized when the engine speed is changing substantially and utilizes at least the first derivative, preferably the first and second derivatives of the change in engine speed with respect to time to calculate the time at which the stroboscopic lamp is next to be flashed.

After the time for each illumination of the stroboscopic lamp is calculated then the process returns 24 to the beginning where the time delay for the desired timing advance is calculated 10 and the process repeats for each cycle or illumination of the stroboscopic lamp.

In order to use the first and/or second derivatives, as well as any further derivatives of the engine speed with respect to time to calculate the time at which the stroboscopic lamp is to flash, so as to compensate for any changes in engine speed, data representative of engine speed versus time are accumulated and then the desired derivatives are calculated according to well known principles. As those skilled in the art will appreciate, use of the first derivative provides a straight line slope which is a general approximation of the expected speed of the engine for the next cycle thereof. By utilizing the second derivative, which is indicative of the change of slope or the change in the rate at which the speed is varying, an even better approximation of the speed of the engine at the next cycle is provided. Further derivatives provide a more accurate prediction of the speed of the engine during the next cycle.

Figure 3:
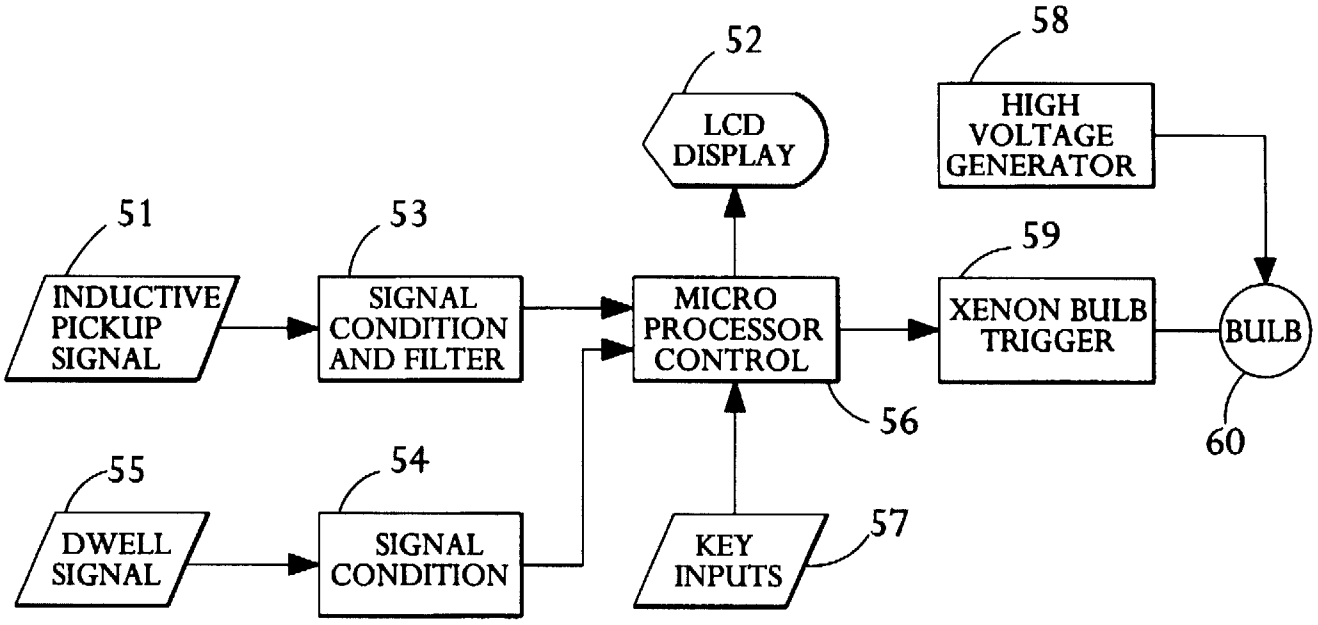
FIG. 3 is a block diagram of the timing light of the present invention.

Referring now to FIG. 3, a block diagram of the timing light of the present invention is provided. An inductive pick up signal 51 is provided according to well known principles wherein an inductive probe is attached to or placed proximate the spark plug wire for the number one cylinder. The output of the inductance probe is subject to signal conditioning and filtering 53 and then sent to microprocessor control 56. Microprocessor control 56 provides an output to the LCD display so as to provide instructions to the user and to display the desired engine timing. Key inputs 57 allow a user to input the desired engine timing into microprocessor control 56, such that the required delay can be calculated.

Optionally, a dwell signal 55 may be provided through signal conditioning 54 to the microprocessor control 56 and, if desired, displayed upon LCD display 52.

The microprocessor control 56 calculates the desired delay so as to cause the stroboscopic lamp or bulb 60 to illuminate when the index on the rotating pulley is in alignment with the 0° mark on the stationary engine when the distributor is rotated to a position such that the desired engine timing is provided. The xenon bulb trigger 58 causes the stroboscopic lamp or bulb 60 to illuminate. High voltage generator 58 supplies the required high voltage to the bulb to facilitate illumination when the trigger signal is received thereby.

Figure 4:
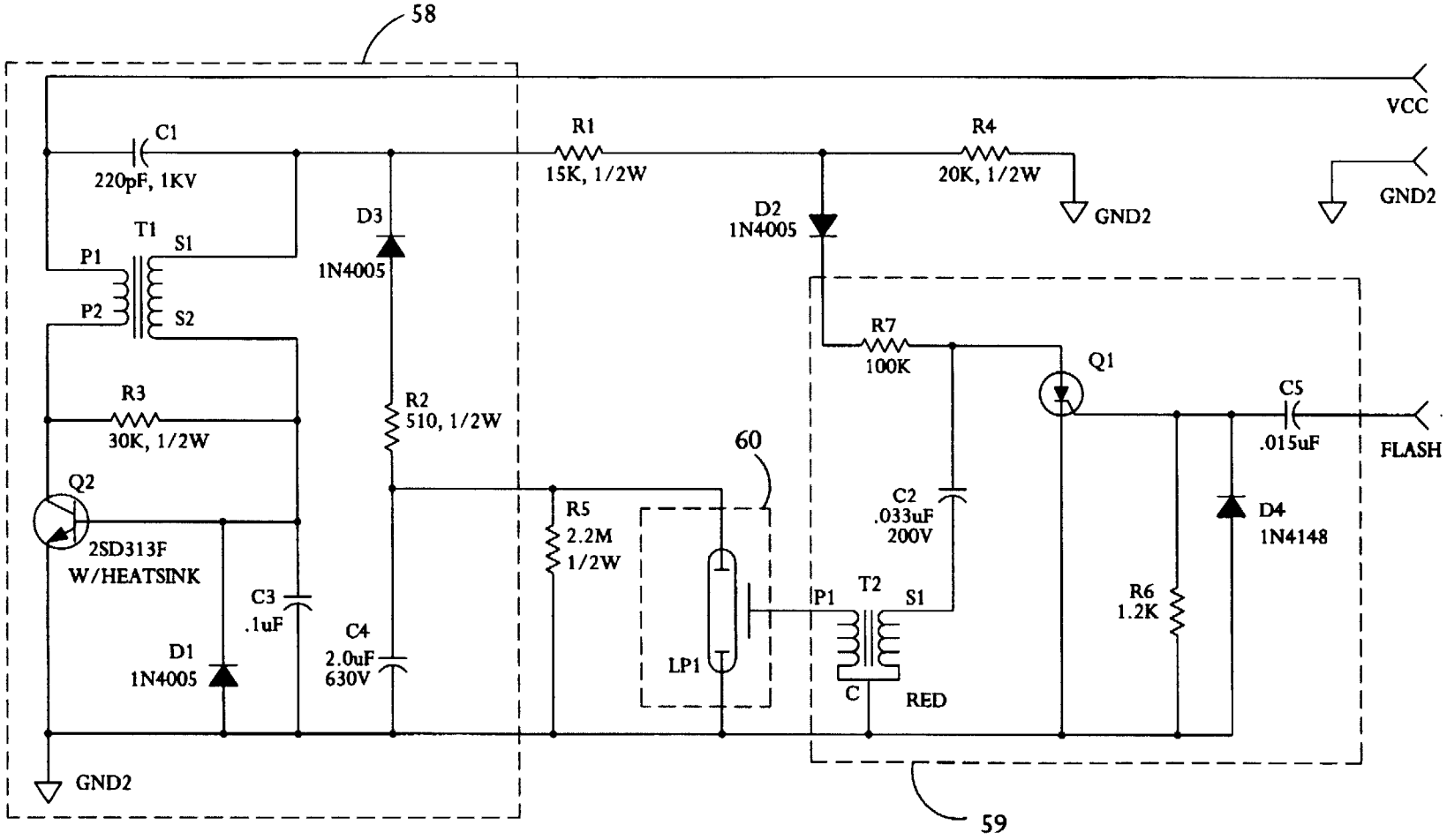
FIG. 4 is an electrical schematic of the high voltage board of the timing light of the present invention.

Referring now to FIG. 4, the high voltage circuit for driving and triggering the stroboscopic lamp 60 is provided. The flash signal is provided to the xenon bulb trigger circuit 59 from the microprocessor control 56 at the desired delayed time. The xenon bulb trigger circuit 59 generates a trigger signal for the stroboscopic lamp 60 according to well known principles.

High voltage generator 58 provides the high voltage drive signal for the stroboscopic lamp 60 according to well known principles.

Figure 5:
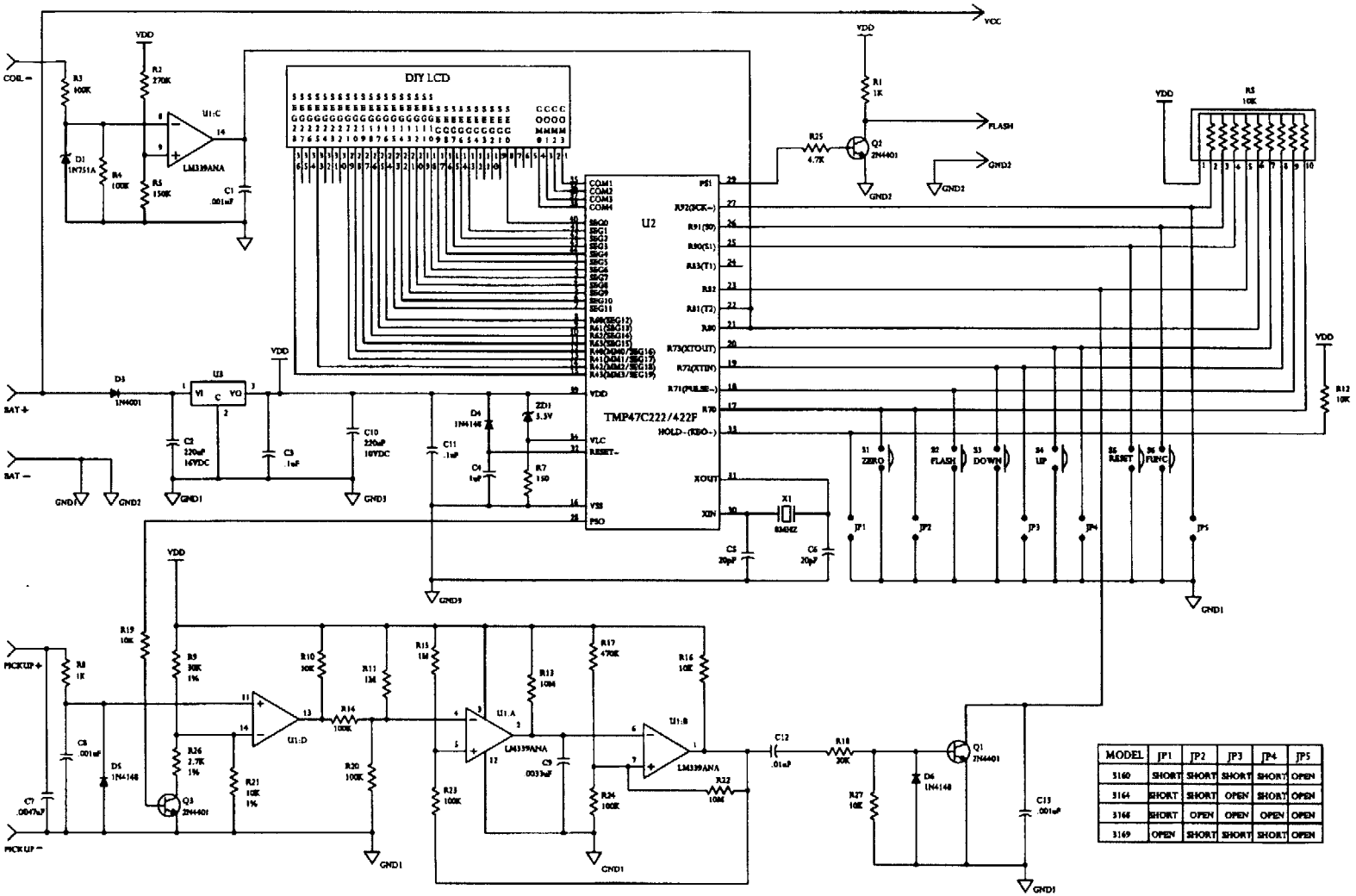
FIG. 5 is an electrical schematic of the digital signal processing circuitry of the timing light of the present invention.

Referring now to FIG. 5, the dwell signal conditioning circuit 54 receives the dwell signal from the coil and provides a signal representative thereof to the microprocessor control 56 such that the dwell may be displayed upon the LCD display 52, if desired. Inductive pick up signal conditioning and filtering electronics 53 receives the signal from the inductive pick up 51 (FIG. 3) and conditions and filters the inductive pick up signal according to well known principles. A signal representative of the inductive pick up signal is provided to the microprocessor control 56 such that a trigger signal for the stroboscopic lamp 60 may be generated therefrom.

Key pad 57 facilitates the entry of data representative of the desired engine timing and functions to be performed by the device.

The microprocessor control 56 preferably comprises a TMP47C222/422E microprocessor. As those skilled in the art will appreciate, various different microprocessors are likewise suitable.

Tachometer rpm[@t(n)] Range: 30–9,990 RPM and $\Delta T[@t(n)]=120\div rpm[@t(n)]$ then $\Delta T$ Range: 0.012 sec–4 sec Assumption used to predict $AT(n+1)$ in order to calculate $\Delta ta$ and $\Delta tr$:

The $\Delta T(n)$ Try to Remains Constant, therefor $\Delta T(n+1)=\mu$ $\Delta ta=D\times\mu+720$ $\Delta tr=\mu-D\times\mu+720$ Where $\mu=\frac{1}{2}\times\Delta T(n)+\frac{1}{4}\times\Delta T(n-1)+\frac{1}{4}\Delta T(n-2)$ The computing of $\Delta ta$ or $\Delta tr$ time delay is not only depend on current $\Delta T(n)$ and selected advance/retard value, but also depend previous $\Delta T(n-1)$ and $\Delta T(n-2)$ which represent the change factor and trend of previous RPM. This assumption is much more accurate than Snap-On because when the automobile try to remain RPM constant, engine still will speeds up or slows down because the physical principle. When RPM is constant, this assumption would derive the same result of $\Delta T(n+1)=\Delta T(n)$ as Snap-On.

A listing of the program steps executed by the microprocessor control 56 to measure timing according to the present invention follows:

It is understood that the exemplary timing light described herein and shown in the drawings represents only a presently preferred embodiment of the invention. Indeed, various modifications and additions may be made to such embodiment without departing from the spirit and scope of the invention. For example, those skilled in the art will appreciate that various different algorithms for predicting the time for generating the next trigger pulse for both steady state and changing speed conditions are well known. Also, the present invention may be utilized with various different types of sensors which provide a signal to the input circuit of the present invention. Thus, these and other modifications and additions may be obvious to those skilled in the art and may be implemented to adapt the present invention for use in a variety of different applications.

What is claimed is:

1. A timing light for detecting an engine's timing, the timing light comprising:

a) a stroboscopic lamp for illuminating the timing marks on an engine;

b) a trigger circuit for causing the stroboscopic lamp to illuminate the timing marks, said trigger circuit comprising:

i) an input circuit receiving a signal representative of a spark plug firing;

ii) an output circuit for communicating a next trigger signal to the stroboscopic lamp to cause the stroboscopic lamp to illuminate;

iii) an anticipation circuit configured to determine when to generate the next trigger signal by extrapolating a time of the next trigger signal by determining a rate of change of times between a plurality of prior trigger signals;

c) wherein extrapolating the time of the next trigger signal enhances an accuracy with which the engine's timing is measured.

2. The timing light as recited in claim 1 wherein the step of extrapolating the time of the next trigger signal comprises determining the period between a plurality of prior trigger signals and offsetting the time of the next trigger signal by a factor corresponding to the rate of change of prior trigger signals.

3. The timing light as recited in claim 1 wherein the anticipation circuit is configured to establish a trend utilizing at least a first derivative of engine speed with respect to time.

4. The timing light as recited in claim 1 wherein the anticipation circuit is configured to establish a trend utilizing at least the first derivative of engine speed with respect to time and the second derivative of engine speed with respect to time.

5. The timing light as recited in claim 1 wherein:

a) the anticipation circuit operates in a first mode when the engine speed is substantially steady, in the first mode the time at which the trigger signal is provided to the stroboscopic lamp is determined utilizing a weighted average of a plurality of previous time intervals between trigger signals; and b) the anticipation circuit operates in a second mode when the engine speed is changing substantially, in the second mode the time at which the trigger signal is provided to the stroboscopic lamp is determined utilizing at least a first derivative of engine speed with respect to time.

6. The timing light as recited in claim 5 wherein the weighted average is determined by adding on half of the previous time interval to one fourth of the time interval before that to one fourth the time interval before that.

7. The timing light as recited in claim 5 wherein:

a) the anticipation circuit is configured to operate in the first mode when a predetermined number of previous time intervals have been within a predetermined range; and b) the anticipation circuit is configured to operate in the second mode when a predetermined number of previous time intervals have been outside of the predetermined range.

8. The timing light as recited in claim 5 wherein the anticipation circuit is configured to operate in the second mode when a predetermined number of previous time intervals have been one of progressively shorter in duration and progressively larger in duration, and otherwise to operate in the first mode thereof.

9. The timing light as recited in claim 5 wherein the desired time for the stroboscopic lamp to illuminate the timing marks is a time delayed by an amount of time by which engine timing is to be advanced when advanced timing is desired and is a time delayed by an amount of time by which engine timing is to be retarded when retarded timing is desired.

* * * * *